US007165495B2

(12) United States Patent
Adachi

(10) Patent No.: US 7,165,495 B2
(45) Date of Patent: Jan. 23, 2007

(54) APPARATUS FOR REMOVING AND/OR RECOVERING INK, PRINTING MACHINE INCLUDING SUCH APPARATUS, AND METHOD FOR SUPPLYING AND/OR RECOVERING INK

(75) Inventor: Nokihisa Adachi, Aichi-ken (JP)

(73) Assignee: Kabushiki Kaisha Isowa, Aichi-ken (JP)

( * ) Notice: Subject to any disclaimer, the term of this patent is extended or adjusted under 35 U.S.C. 154(b) by 0 days.

(21) Appl. No.: 10/738,548

(22) Filed: Dec. 17, 2003

(65) Prior Publication Data

US 2004/0129156 A1 Jul. 8, 2004

(30) Foreign Application Priority Data

Dec. 27, 2002 (JP) ..... 2002-378787
Jun. 9, 2003 (JP) ..... 2003-164197

(51) Int. Cl.
*B41F 35/00* (2006.01)
*A47L 5/00* (2006.01)

(52) U.S. Cl. ..... 101/483; 101/425; 101/351.1; 15/300.1

(58) Field of Classification Search ..... 101/483, 101/424, 425, 351.1; 15/300.1, 321
See application file for complete search history.

(56) References Cited

U.S. PATENT DOCUMENTS 3,896,730 A * 7/1975 Garrett et al. ..... 101/425
5,003,877 A * 4/1991 Yano et al. ..... 101/363
5,165,342 A 11/1992 Weishew
5,539,952 A * 7/1996 Hayes et al. ..... 15/321

(Continued)

FOREIGN PATENT DOCUMENTS

DE 197 05 006 A1 8/1997
DE 197 57 094 A1 6/1999
EP 0 612 618 A2 8/1994

(Continued)

OTHER PUBLICATIONS

Search Report in Japanese Patent Appln. 2003–164197 (Mar. 24, 2006).

(Continued)

*Primary Examiner*—Ren Yan
(74) *Attorney, Agent, or Firm*—Stroock & Stroock & Lavan LLP

(57) ABSTRACT

A printing machine in which excessive ink remaining in ink delivery tubings (20, 22, 24) each connecting an ink reservoir (16) to an ink supply source (18) can be quickly removed or rinsed out is provided.

The printing machine according to the present invention includes the ink reservoir (16), the ink supply source (18), and one or more of the ink supply tubing (20) and ink recovery tubings (22, 24) each connecting said ink reservoir (16) to said ink supply source (18), whereby the ink supplied from said ink supply source (18) via at least one of said ink delivery tubings to said ink reservoir (16) and accumulated therein is used for printing, and wherein the printing machine further comprises one or more ink removing means for removing said ink remaining in said ink supply tubing (20) and ink recovery tubings (22, 24), each of said one or more ink removing means including respective air supply means (26A, 26B, 26C) which supply a fast enough flow rate and/or large enough flow volume of air into said ink supply tubing (20) and ink recovery tubings (22, 24) such that the air flows toward said ink supply source from said ink reservoir in order to remove said ink remaining on the inner surface of said ink supply tubing (20) and ink recovery tubings (22, 24).

11 Claims, 7 Drawing Sheets

U.S. PATENT DOCUMENTS

| | | | | | |
|---|---|---|---|---|---|
| 5,644,986 | A | * | 7/1997 | Gydesen | 101/424 |
| 5,772,787 | A | * | 6/1998 | Weishew | 134/26 |
| 5,816,163 | A | * | 10/1998 | Achelpohl et al. | 101/483 |
| 5,967,044 | A | * | 10/1999 | Marschke | 101/363 |

FOREIGN PATENT DOCUMENTS

| | | | |
|---|---|---|---|
| EP | 0 950 521 | B1 | 10/1999 |
| EP | 1 260 367 | A2 | 11/2002 |
| GB | 1 318 581 | A | 5/1970 |
| JP | SHO56-176846 | U | 12/1981 |
| JP | 58-142852 | A | 8/1983 |
| JP | 60-154132 | | 10/1985 |
| JP | 63-77737 | U | 5/1988 |
| JP | 3-14367 | U | 2/1991 |
| JP | 3-14367 | Y2 | 3/1991 |
| JP | 05-220938 | | 8/1993 |
| JP | 08-336855 | A | 12/1996 |
| JP | 9-234852 | A | 9/1997 |
| JP | 10-180986 | A | 7/1998 |
| JP | 3053666 | | 11/1998 |
| JP | 10-296961 | A | 11/1998 |
| JP | 11-034302 | | 2/1999 |
| JP | 2598014 | Y2 | 5/1999 |
| JP | 2003-191444 | A | 7/2003 |

OTHER PUBLICATIONS

Notification of Reason for Rejection from Japanese patent appln. 2003–164197, dated Sep. 16, 2005.

Search Report from European patent appln. No. 03029707.1, dated Dec. 8, 2005.

Search Report from European patent appln. No. 05004074.0, dated Dec. 8, 2005.

* cited by examiner

APPARATUS FOR REMOVING AND/OR RECOVERING INK, PRINTING MACHINE INCLUDING SUCH APPARATUS, AND METHOD FOR SUPPLYING AND/OR RECOVERING INK

BACKGROUND OF THE INVENTION

The present invention relates to an apparatus for removing and/or recovering ink, a printing machine including such an apparatus, and a method for supplying and/or recovering ink, and more particularly, to such an apparatus, machine and method which can remove and/or recover ink remaining in ink delivery tubings connecting an ink reservoir to an ink supply source.

Conventionally, when a printing machine prints a sheet of paper, such as a corrugated board with flexographic ink, it is common to press a printing die having ink applied thereon against the surface of the sheet. These printing machines, such as disclosed in Japanese Utility Model publication H03-14367, usually include a pair of rollers, one of which supports the printing die on the outer surface thereof, an ink reservoir formed between said roller and another roller engaging therewith, an ink supply source, and at least one of ink delivery tubings each connecting the ink reservoir to the ink supply source to enable fluid communication therebetween, so that the ink supplied from the ink supply source to the ink reservoir via the ink delivery tubings and accumulated in the ink reservoir is transferred to the printing die and used for printing.

The remaining ink in the ink reservoir is recovered therefrom and returned back to the ink supply source via the ink delivery tubings, after the printing operation has finished. However, even after the ink remaining in the ink reservoir has been completely recovered from the ink reservoir and returned back to the ink supply source via the ink delivery tubings, excess ink still remains on the surfaces of the pair of rollers and the ink reservoir, and on the inner surfaces of the ink delivery tubings, therefore it is important to remove or rinse out such remaining ink as quickly as possible before successive printing operation which uses ink of another color is conducted.

There are several technical problems in such printing machines, especially due to the ink remaining in the ink delivery tubings.

The first problem is that the ink used in the previous printing operation and still remaining in the ink delivery tubings will be mixed with ink of a new, different color upon the start of a successive printing operation, thereby the printed color does not precisely match the color of the new ink. A printing color is quite often changed even in one day, since small lot productions are recently required. Japanese Utility Model Laid-open publication S63-77737 discloses a printing machine wherein excess ink remaining in the ink reservoir can be recovered and sent back to the ink supply source via the ink delivery tubings by using an air ejector. Although it would be possible to remove ink remaining in the ink reservoir according to this apparatus, it is still difficult to remove ink remaining in the ink delivery tubings.

The second problem is that it is difficult to efficiently remove ink remaining in the ink delivery tubings such as ink supply tubings or ink recovery tubings. Japanese patent 2,954,895 discloses an apparatus for recovering flexographic ink remaining on the surface of a pair of rollers wherein the remaining ink is diluted, and then recovered via the ink delivery tubings after supplying a sufficient amount of diluting liquid to the ink reservoir. It would be possible, according to this apparatus, to remove some of the ink remaining in the ink delivery tubings by diluted ink flowing through the ink delivery tubings.

However, it is difficult to completely remove all of the ink from the ink delivery tubings, therefore the ink delivery tubings must be rinsed out again using a large amount of rinsing water.

The third problem is that it is difficult to recover ink from the ink delivery tubings such as ink supply tubings and ink recovery tubings, so that the recovered ink can be reused thereafter. Although the excess ink remaining in the ink delivery tubings could be removed by rinsing the ink supply tubings and ink recovery tubings, the recovered ink will be diluted so much that it cannot be reused for printing. If the ink can be recovered while still in its reusable form, the loss of the ink will be reduced.

According to the prior art, the excess ink remaining in the ink reservoir and/or on the surface of the pair of rollers is recovered, however, excess ink remaining in the ink delivery tubings has to be rinsed out with a large amount of rinsing water, thus causing significant amount of loss of ink and waste water, whereby harm to the environment is caused.

As to the amount of loss of ink and of waste water, assuming a flexographic printing machine for corrugated boards of 2,500 mm in width among others, the machine including a conventional ink recovery system, the amount of flexographic ink wasted upon color change, i.e. remaining in the ink supply tubings, ink recovery tubings, and on the ink pan which should be rinsed out by rinsing water, is about 150 grams for each color thereof (assuming that flexographic ink remaining in the ink reservoir is recovered by the ink recovery system thereof.). The amount of rinsing water which is consumed for rinsing out such flexographic ink is about 50 liters. Therefore, when a color change is required 30 times a day, each color of ink wasted in a day will be 150 grams times 30, that is 4,500 grams, for each printing machines. Similarly, waste water required for rinsing flexographic ink out from the ink supply tubings, ink recovery tubings, and the ink pan, will be 50 liters times 30, that is 1,500 liters in a day. Thus it can be seen from the above that, conventional flexographic printing machine has been required to waste large amounts of flexographic ink and rinsing water.

Thus, one object of the present invention is to provide an apparatus for removing and/or recovering ink, a printing machine including such an apparatus, and a method for supplying and/or recovering ink, which can remove ink remaining in ink delivery tubings connecting an ink reservoir to an ink supply source, thereby preventing a change of printing color due to the mixture of a previous ink and new ink.

Another object of the present invention is to provide an apparatus for removing and/or recovering ink, a printing machine including such an apparatus, and a method for supplying and/or recovering ink, which can quickly remove or rinse out the ink remaining in ink delivery tubings connecting an ink reservoir to an ink supply source.

Still another object of the present invention is to provide an apparatus for removing and/or recovering ink, a printing machine including such an apparatus, and a method for supplying and/or recovering ink, which can recover the ink while it is still in its reusable form, which remains in ink delivery tubings connected between an ink reservoir and an ink supply source.

SUMMARY OF THE INVENTION

A printing machine according to the present invention includes:

an ink reservoir, an ink supply source, and one or more ink delivery tubings each connecting said ink reservoir to said ink supply source, whereby the ink supplied from said ink supply source via at least one of said ink delivery tubings to said ink reservoir and accumulated therein is used for printing, wherein the printing machine further comprises one or more ink removing means for removing said ink remaining in said ink delivery tubings, each of said one or more ink removing means including respective air supply means which supply a fast enough flow rate and/or strong enough flow volume of air into said ink delivery tubings such that the air flows toward said ink supply source in the direction away from said ink reservoir in order to remove said ink remaining on the inner surface of said ink delivery tubings.

One preferable embodiment of the printing machine according to the present invention further comprising one or more ink transfer means for transferring said ink between said ink reservoir and said ink supply source via said ink delivery tubings, wherein each of said ink transfer means transfers said ink via said ink delivery tubings before and during the printing operation of the printing machine, while each of said ink transfer means moves air in said ink delivery tubings after the printing operation of the printing machine has finished.

In another preferable embodiment of the printing machine according to the present invention, said ink removing means further includes at least one diluting liquid supply means which supply a liquid in said ink delivery tubings such that the liquid flows toward said ink supply source from said ink reservoir in order to dilute said ink remaining therein.

Furthermore, said ink removing means may further include at least one viscometer for detecting the viscosity of said ink being removed from said ink delivery tubings, and at least one adjusting means for adjusting the amount of diluting liquid supplied by said diluting liquid supply means in response to the viscosity detected by said viscometer.

In the printing machine according to the invention, it is preferable that each of said air supply means comprise air flow tubings connected to be in fluid communication with said respective ink delivery tubings in close proximity to opening ends thereof adjacent to said ink supply source, and air suction means disposed within said air flow tubings for sucking air down from said ink delivery tubings by virtue of air flow passing through said air flow tubings.

In the above preferable embodiment of the printing machine according to the invention, each of said air supply means comprise air/gas introduction means which introduce air/gas into said ink delivery tubings in the close proximity to opening ends thereof adjacent to said ink supply source.

In one embodiment of the printing machine according to the present invention, said diluting liquid supply means may comprise diluting liquid tubings connected to be in fluid communication with said respective ink delivery tubings in close proximity to opening ends thereof adjacent to said ink reservoir, and a diluting liquid source connected to said diluting liquid tubings, respectively.

In one preferable embodiment of the printing machine according to the invention, said ink delivery tubing comprises one or more ink supply tubings for supplying said ink from said ink supply source to said ink reservoir, and one or more ink recovery tubings for recovering said ink from said ink reservoir and returning it back to said ink supply source, said ink supply tubings and/or said ink recovery tubings include ink transfer means which can transfer said ink in and vice versa between said ink supply source and said ink reservoir, whereby said ink supply tubings can operate as ink recovery tubings and/or said ink recovery tubings can operate as ink supply tubings.

In one embodiment of the printing machine according to the invention, said ink reservoir may be formed by an inking roller which applies said ink to a printing die, an ink squeezing member extending along the axis of said inking roller in contact with the same for the adjustment of the amount of said ink being applied to the printing die, and a pair of diaphragms or dam plates disposed at common end extremities of said inking roller and said ink squeezing member, comprising one or more driving means which move said opening ends of at least one of said ink delivery tubings adjacent to said ink reservoir along said axis of the inking roller.

A method for supplying and/or recovering ink according to the present invention including:

said ink being supplied and/or recovered via at least one of ink delivery tubings connecting an ink reservoir to an ink supply source, wherein the method includes the step of supplying a fast enough flow rate and/or strong enough flow volume of air into said ink delivery tubings such that the air flows toward said ink supply source in the direction away from said ink reservoir, and the step of supplying a diluting liquid in said ink delivery tubings intermittently so that the liquid flows toward said ink supply source from said ink reservoir, and wherein said supplying steps occur simultaneously in order to recover said ink remaining on the inner surfaces of said ink delivery tubings.

In one preferable embodiment of the method according to the invention, the method may further include the step of detecting the viscosity of said ink being removed from said ink delivery tubings, and the step of adjusting the amount of said diluting liquid in response to the viscosity detected by said step of detecting.

An apparatus for removing and/or recovering ink according to the invention is:

an apparatus for removing and/or recovering ink remaining in one or more ink delivery tubings connecting an ink reservoir to an ink supply source, wherein the apparatus includes air supply means which supplies a fast enough flow rate and/or strong enough flow volume of air into said ink delivery tubings such that the air flows toward said ink supply source in the direction away from said ink reservoir in order to remove said ink remaining on the inner surfaces of said ink delivery tubings.

According to the printing machine of the present invention described above, a sheet of paper is printed by utilizing the ink supplied from the ink supply source to the ink reservoir and accumulated therein via ink delivery tubings. Once the printing operation of the printing machine has finished, excess ink remaining in the ink reservoir is recovered therefrom and returned back to the ink supply source via the ink delivery tubings, thereafter the ink remaining on the inner surfaces of the ink delivery tubings being removed by one or more air supply means which supply a fast enough flow rate and/or strong enough flow volume of air into the ink delivery tubings such that the air flows toward the ink supply source in the direction away from the ink reservoir. Therefore, the invention makes it possible to effectively prevent the change of the color printed to a color different from the color of the new ink, which can be caused by the mixture of the new ink supplied from the new ink supply source with the ink previously used and still remaining in the ink delivery tubings.

DETAILED DESCRIPTION OF THE PREFERRED EMBODIMENTS OF THE INVENTION

The above objects and other objects, features, and advantages of the present invention will be readily apparent from the following detailed description of the printing machines of the preferred embodiments for carrying out the invention when taken in connection with the accompanying drawings. These printing machines are operated for printing corrugated boards with flexographic ink.

Figure 1:
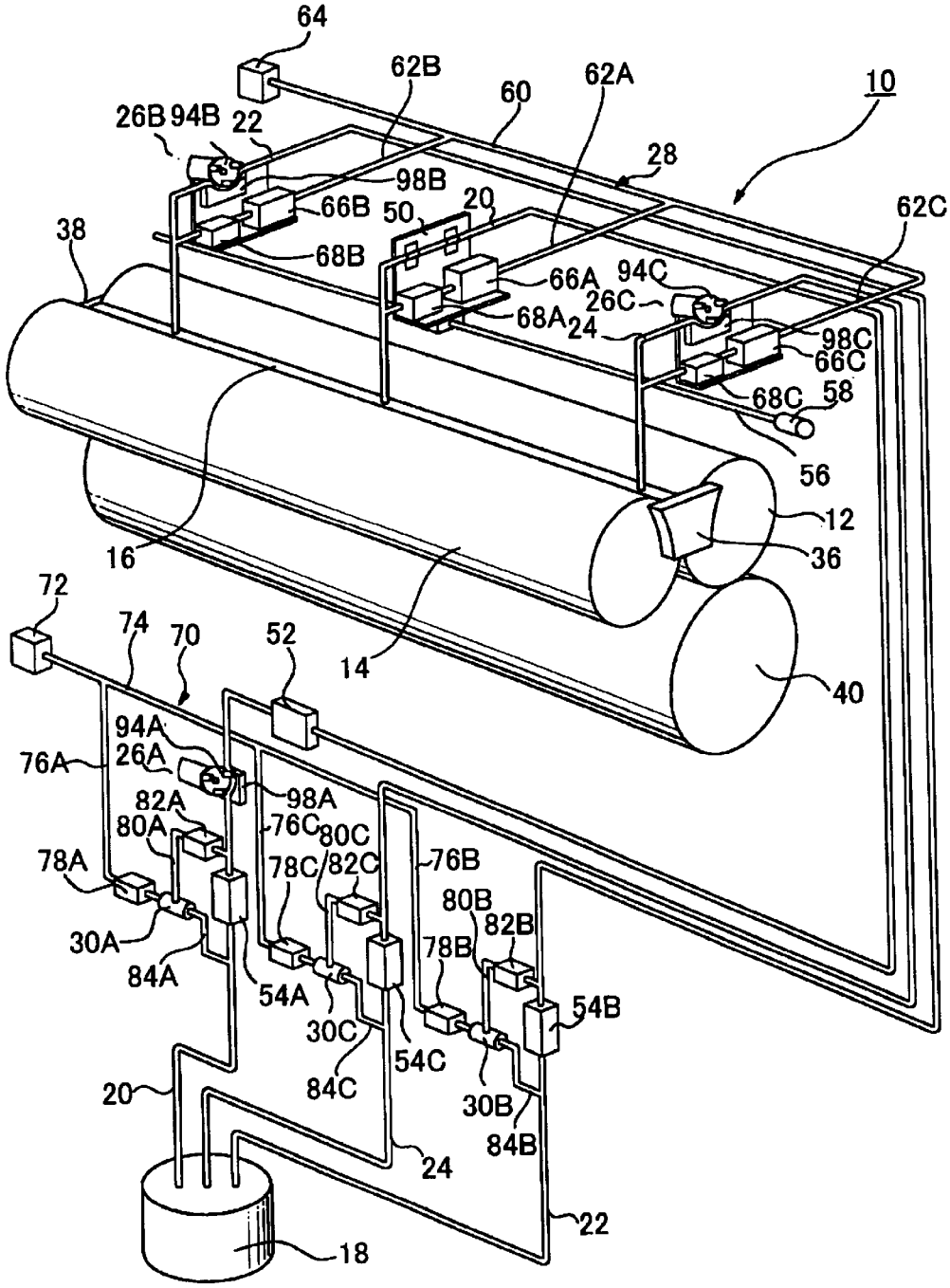
FIG. 1 is a perspective view showing a printing machine of the first preferred embodiment of the present invention.
Figure 2:
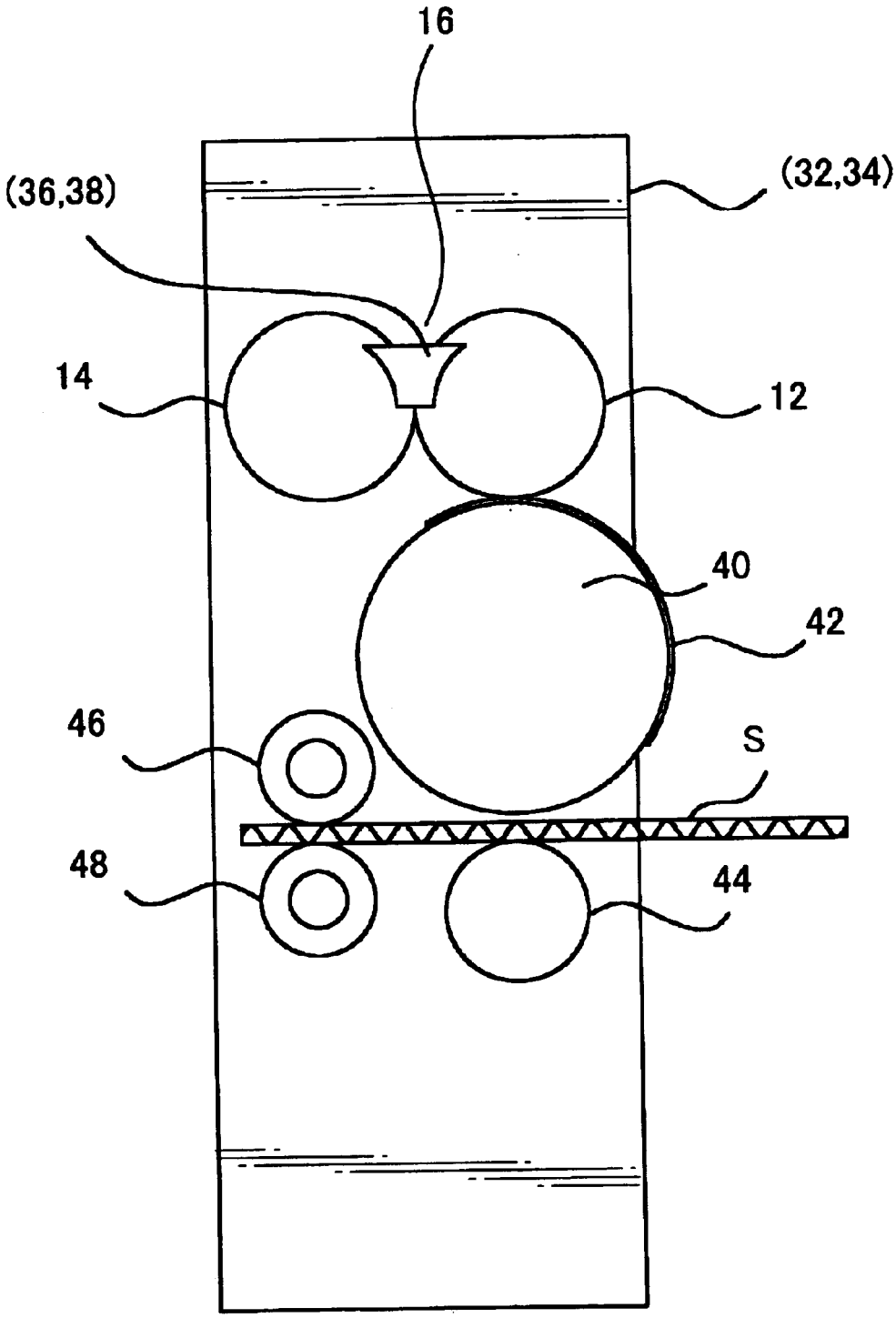
FIG. 2 is a side elevational view showing the printing section of the printing machine illustrated in FIG. 1.
Figure 3:
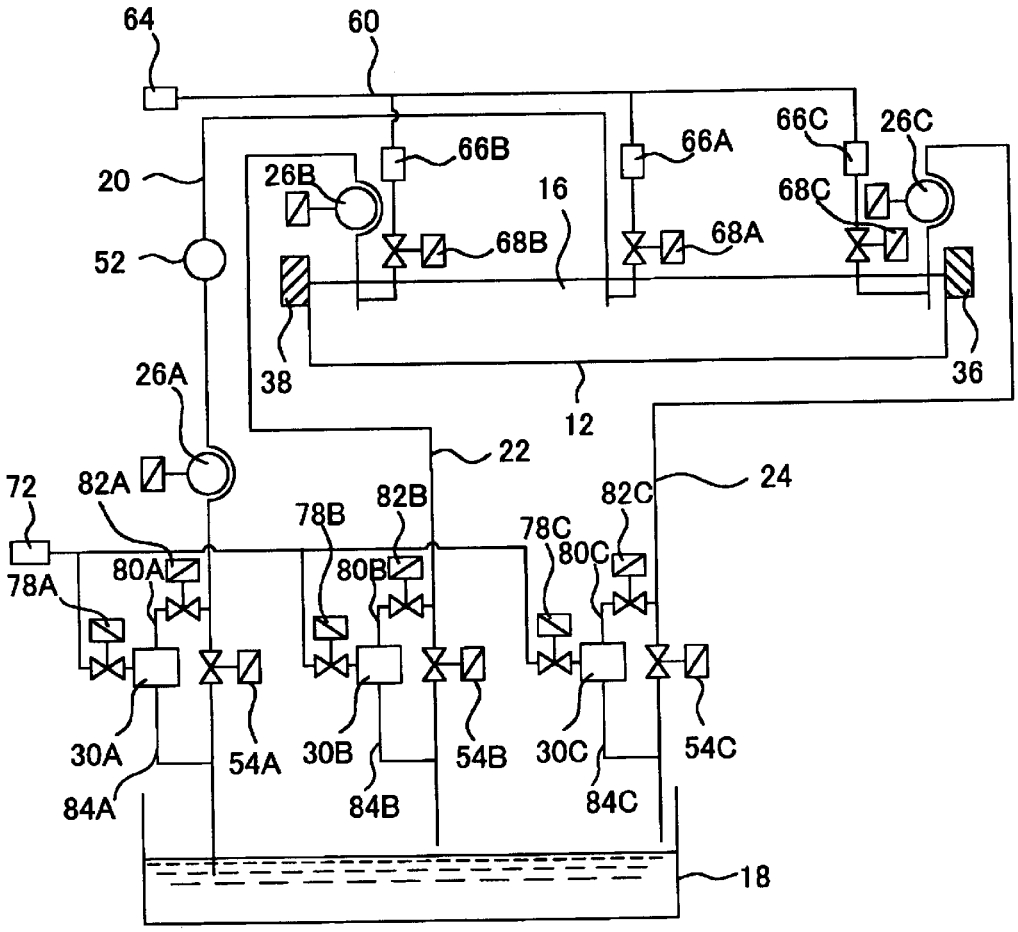
FIG. 3 is a piping diagram showing relationships of various tubings and elements of the printing machine illustrated in FIG. 1.

FIG. 1 is a perspective view showing a printing machine of the first preferred embodiment of the present invention. FIG. 2 is a side elevational view showing the printing section of the printing machine illustrated in FIG. 1. FIG. 3 is a piping diagram showing relationships of various tubings and elements of the printing machine illustrated in FIG. 1.

As can be seen in FIG. 1, a printing machine 10 includes an ink reservoir 16 formed by a pair of rollers 12 and 14, an ink supply source 18 disposed underneath the ink reservoir 16, an ink supply tubing 20 and ink recovery tubings 22 and 24 each connecting the ink reservoir 16 to the ink supply source 18 to provide fluid communication therebetween, ink transfer pumps 26A, 26B and 26C for transferring ink via the ink supply tubing 20 and the ink recovery tubings 22 and 24, respectively, a water supply tubing 28 for supplying water into the ink supply tubing 20 and the ink recovery tubings 22 and 24, respectively, and air ejectors 30A, 30B and 30C each of which generates an air flow in the ink supply tubing 20 and ink recovery tubings 22 and 24, respectively, in order to remove or recover remaining ink in the ink supply tubing 20 and the ink recovery tubings 22 and 24.

As can be seen in FIG. 2, the ink reservoir 16 is formed by an inking roller 12 and an ink squeezing roller 14 which are supported in contact with each other and both of which are supported between a pair of machine frames 32 and 34, and by a pair of diaphragms or dam plates 36 and 38 which are supported in a sliding contact relationship with the inking roller 12 and the ink squeezing roller 14 at the common end extremities thereof and which are also supported on the pair of machine frames 32 and 34. The inking roller 12 and the ink squeezing roller 14 are kept in a contact with each other during a printing operation of the printing machine. A printing cylinder 40 disposed under the inking roller 12 and rotatably supported by the pair of machine frames 32 and 34, supports a printing die 42 on the outer surface thereof, whereby the printing die 42 is supported in contact with the inking roller 12. A corrugated board sheet S is supplied between the printing cylinder 40 and an impression cylinder 44 disposed under the printing cylinder 40 and rotatably supported by the pair of machine frames 32 and 34. When the corrugated board sheet S comes into contact with the printing die 42, flexographic ink applied on the surface of the printing die 42 is transferred or printed onto the sheet S. After the corrugated board sheet is printed with the flexographic ink, it will be fed to the next process stage via a pair of feed rollers 46 and 48.

As can be seen in FIG. 1, the ink supply source 18 is a container for keeping ink therein and disposed in the lowest position of the printing machine, and the opening end of the ink supply tubing 20, that of the ink recovery tubing 22, and that of the recovery tubing 24 are positioned inside the ink supply source 18, as discribed in further detail below. The ink supply source 18 has to be replaced with that filled with another color of ink when the printing color is to be changed.

As can be seen in FIG. 1, one opening end of the ink supply tubing 20 is positioned adjacent to the ink reservoir 16, while the other opening end thereof is positioned adjacent to or inserted in the ink supply source 18. The inner diameter and the length of the ink supply tubing 20 may be chosen depending on various conditions such as the desired flow rate of the ink or distance between the ink supply source 18 and the ink reservoir 16. The ink supply tube may be, for example, 8 mm in its inner diameter and 5 m in its length, and made of plastic. There is provided in the direction from the ink reservoir 16 to the ink supply source 18 for the ink supply tubing 20 a bracket 50 for supporting the ink supply tubing 20, a viscometer 52 for detecting the viscosity of the flexographic ink therein which will be explained in more detail below, and a transfer pump 26A and open-close valve 54A both of which will be explained in more detail below. A threaded shaft 56 threadedly engaging with the bracket 50 is rotationally disposed above the ink reservoir 16 along the axes of the rollers 12 and 14, and a driving motor 58 is attached at one end of the threaded shaft 56, while the other end thereof (not shown) is supported by the pair of machine frames 32 and 34. The threaded shaft 56 is rotated by the rotation of the driving motor 58, which moves the opening end of the ink supply tubing 20 along the longitudinal direction of the ink reservoir 16.

A water supply tubing 28 includes a straight tubing portion 60 disposed above the ink reservoir 16 along the longitudinal direction thereof, and three branch tubing portions 62A, 62B and 62C branched off from the straight tubing portion 60, respectively. There are three junction points spaced apart from each other along the longitudinal direction of the ink reservoir 16, i.e., positioned at one end, middle part and the other end thereof. A water supply source 64 is connected to one opening end of the straight tubing portion 60. An opening end of the branch tubing portion 62A is connected to the ink supply tubing 20 to be in fluid communication therewith. The opening end of the branch tubing portion 62B is connected to the ink recovery tubings 22 and that of the portion 62C is connected to 24, respectively. In the direction from the straight tubing portion 60 to the ink reservoir 16, a water flow meter 66A and an open-close valve 68A are included within the branch tubing portion 62A. The time intervals for feeding water are controlled by the operation of the open-close valve 68A in relation to the amount of the water flowing through the ink supply tubing 20, this flow rate being detected by the water flow meter 66A.

A high pressure air supply tubing 70 disposed below the pair of rollers 12 and 14 is connected to a high pressure air source 72 of about 5 kg/cm$^2$ in pressure. The high pressure air tubing 70 includes a straight tubing portion 74 disposed along the longitudinal direction of the ink reservoir 16, and three branch tubing portions 76A, 76B and 76C branched off from the straight tubing portion 74, respectively. The branch tubing portions 76A, 76B and 76C are connected to air ejectors 30A, 30B and 30C, respectively, thus providing fluid communication therebetween by open-close valves 78A, 78B and 78C. The primary port of the air ejector 30A is connected to the ink supply tubing 20 at a portion thereof which is located slightly apart from the open-close valve 54A and toward the ink reservoir 16 via a by-pass tubing 80A including an open-close valve 82A. The secondary port of the air ejector 30A is connected to the ink supply tubing 20 at a portion thereof which is located slightly apart from the open-close valve 54A toward the ink supply source 18 via a by-pass tubing 84A.

The air ejectors 30 known in the art operate as follows. An air ejector 30 includes a diffuser therewithin (not shown) and an expansion chamber (not shown) in fluid communication with the constriction side of the diffuser. The primary compression air supplied via the open-close valve 78 and injected into the expansion chamber from a nozzle (not shown) expands and flows into the diffuser at a high flow speed, whereby pressure in the expansion chamber drops. The pressure difference caused thereby is utilized for drawing secondary air out of via the open-close valve 82A, which is mixed and passes through the diffuser with the primary air, and then flows into the ink supply tubing 20 via the by-pass tubing 84.

Figure 7:
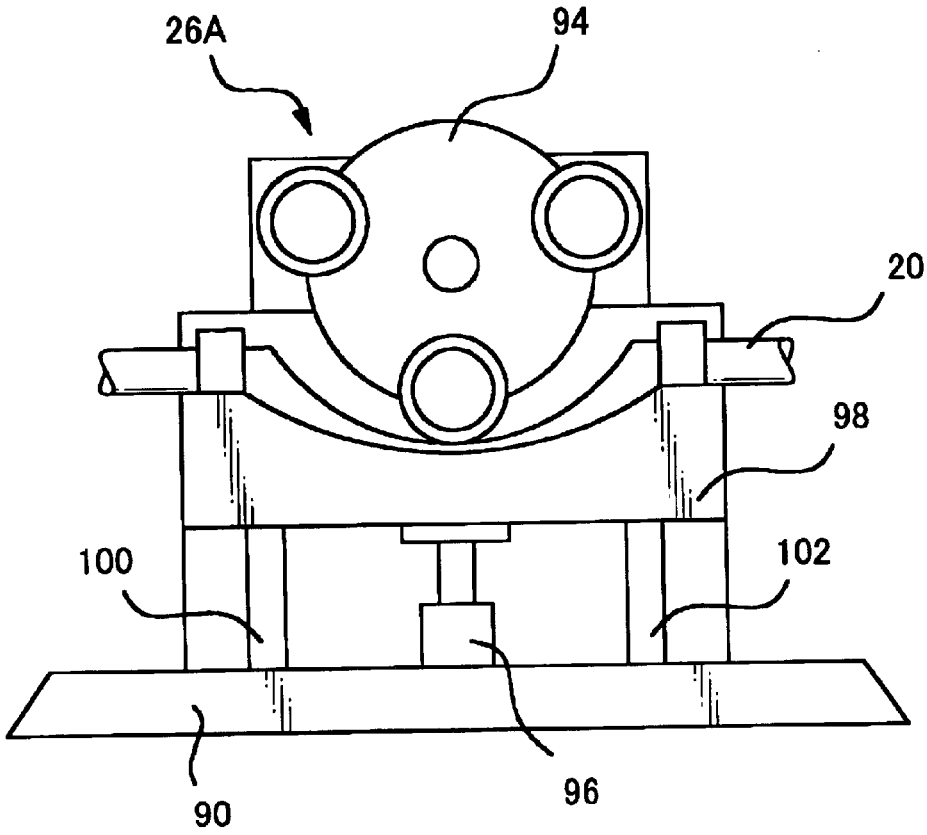
FIG. 7 is a schematical front view showing a tubing pump.
Figure 8:
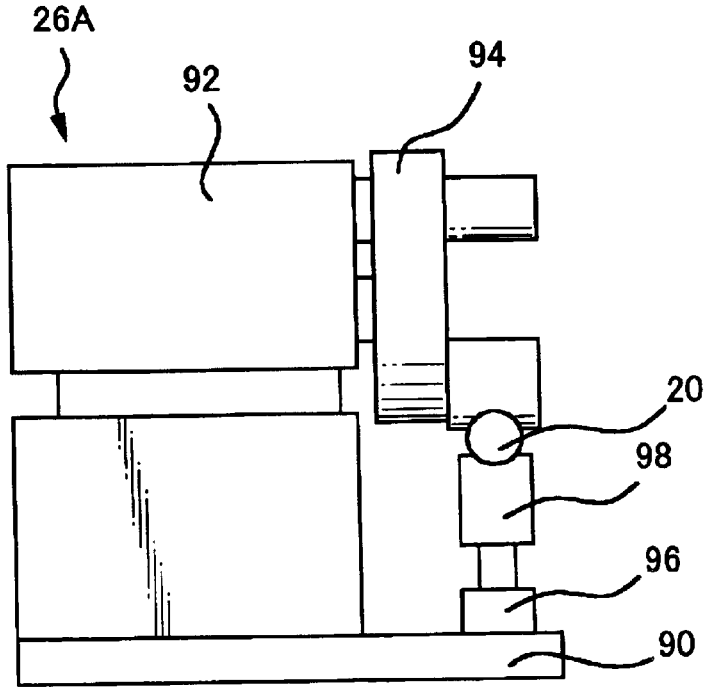
FIG. 8 is a schematical side view showing a tubing pump.

Now, the transfer pump 26A will be explained in detail with reference to the FIGS. 7 and 8. The transfer pump is a tubing pump of a known type which transfers flexographic ink in the ink supply tubing 20. A motor 92 is supported upon a base plate 90 and the motor has a rotor 94 fixedly attached on the driving shaft thereof, which applies a rotational pressure force against the outer surface of the ink supply tubing 20. A supporting member 98 which supports the ink supply tubing 20 thereon is attached at the top end of the driving rod of an air cylinder 96 which is attached to the base plate 90. The supporting member 98 guided along a pair of guide bars 100 and 102 fixed on the base plate 90 is moved toward or apart from the rotor 94 by driving the air cylinder 96. In order to transfer flexographic ink from the ink supply source 18 to the ink reservoir 16 by using this tubing pump, the supporting member 98 is moved toward the rotor 94 to apply rotational pressure force against the outer surface of the ink supply tubing 20, whereby the flexographic ink is transferred. On the other hand, in order to release the rotational pressure force applied against the outer surface of the ink supply tubing 20, the supporting member 98 is moved apart from the rotor 94, whereby the ink supply tubing 20 is separated from the rotor. Any other means, besides the air cylinder, such as a threaded shaft, may be used for moving the supporting member 98 toward or apart from the rotor 94. Also, the position of the supporting member 98 relative to the rotor 94 can be adjusted for any ink supply tubings 20 with different diameters, whereby the rotational pressure force applied on the ink supply tubing can be optimized.

The structures relating to the ink recovery tubings 22 and 24 are similar to that of the ink supply tubing 20, except that the flow direction of the ink in the former is opposite to that in the latter, and thus elements or members of the tubings 22 and 24 similar to those previously disclosed with respect to the tubing 20 are designated with the same reference numerals as used for tubing 20, and only points of difference between the tubings 22 and 24 and the tubing 20 will be explained in detail below.

The points of difference between the tubings are as follows: firstly, the ink supply tubing 20 includes the viscometer 52 along its path whereas the ink recovery tubings 22 and 24 do not include the same; secondly, the ink supply tubing 20 has the tubing pump 26A disposed adjacent to the ink supply source 18 whereas the ink recovery tubings 22 and 24 have the respective tubing pumps 26B and 26C disposed adjacent to the ink reservoir 16.

Regarding the first different point mentioned above, although it is advantageous to include the viscometer 52 along the path of the ink supply tubing 20 for detecting the viscosity of the ink being supplied before and/or during the printing operation, the viscometer may instead be positioned along the path of ink recovery tubings 22 and 24 in order to detect the viscosity of the ink being recovered after the printing operation has finished.

The reason for the second different point mentioned above is that, when the ink is transferred by the tubing pump, the resistance due to the flow of the ink can be minimized by placing the tubing pump as near as possible to the ink supply source 18 for the ink supply tubing 20, while placing it as near as possible to the ink reservoir 16 for the ink recovery tubings 22 and 24.

The operation of the printing machine the construction of which has been discussed above will now be explained in detail below, which description covers the respective stages of before, during and after printing.

The operations which have to be done before the printing operation is started are as follows. Various valves are operated before printing. More particularly, the open-close valve 54A is opened to suction the flexographic ink into the ink supply tubing 20. The open-close valve 82A is closed to prevent the flexographic ink from flowing into the by-pass tubing 80A. The open-close valve 78A is closed to prevent the high pressure air from the high pressure air source 72 from flowing into the air ejector 30A. Then, the air cylinder 96 of the transfer pump 26A is driven so that the support member 98 moves toward the rotor 94, whereby a rotational pressure force by the rotor is applied against the outer surface of the ink supply tubing 20. The open-close valve 68A is closed to prevent the water from the water supply tubing 28 from flowing into the ink reservoir 16.

Next, the operations done during the printing operation will be described. The flexographic ink being kept in the ink supply source 18 is supplied to the ink reservoir 16 by driving the transfer pump 26A. The flexographic ink supplied in the ink reservoir 16 is held therein without leaking out therefrom due to a pair of diaphragms or dam plates 36 and 38 disposed at the end extremities of the rollers 12 and 14. The flexographic ink being kept in the ink reservoir 16 is transferred or applied onto the outer surface of the inking roller 12 comprising a portion of the ink reservoir 16, and thereafter the ink is transferred or applied onto the printing die 42, whereby a corrugated board sheet S is printed. During the printing operation discussed above, the amount of the flexographic ink being supplied via the ink supply tubing is more than that required for printing the corrugated board sheet S. Thus, excessive flexographic ink is recovered and returned back to the ink supply source 18 via the ink recovery tubings 22 and 24 by driving the respective tubing pumps 26B and 26C.

The flexographic ink having a quick-drying nature is effectively prevented from being solidified by continuously supplying and recovering it, i.e. by the circulation of the flexographic ink between the ink supply source 18 and the ink reservoir 16. Also, unevenness of the printing can be effectively prevented, which unevenness might occur when the viscosity of the flexographic ink is distributed unevenly along the longitudinal direction of the ink reservoir 16 depending upon the positions of the ink supply tubing 20 and/or the ink recovery tubings 22 and 24. Moreover, the ink supply tubing 20 supported on the bracket 50 may be moved along the longitudinal direction of the ink reservoir 16 by the rotation of the threaded shaft 56 driven by the motor 58 in order to provide an active dynamic flow of the flexographic ink being kept in a particular position in the ink reservoir 16. Printing operation for one lot of corrugated board sheet has finished.

Next, the operations done during the ink removing and/or recovering operation will be described. The flexographic ink still remaining in the ink reservoir 16 is recovered therefrom and returned back to the ink supply source 18. More particularly, the remaining flexographic ink is recovered from the ink reservoir 16 and returned back to the ink supply source 18 via the ink recovery tubings 22 and 24 by the continuous driving movement of the tubing pumps 26B and 26C. Also, at the same time, the transfer pump 26A may be driven in the reversed direction in order to use the ink supply tubing 20 as one of the ink recovery tubing for recovering the flexographic ink from the ink reservoir 16 and returning it to the ink supply source 18. According to such an embodiment, the time required for recovering the flexographic ink from the ink reservoir 16 can be further shortened.

After the transfer pump 26A disposed along the path of the ink supply tubing 20 has stopped, the supporting member 98 is moved apart from the rotor 94 by driving the air cylinder 96, whereby the ink supply tubing 20 is released from the pressure force applied by the rotor 94. Then, the open-close valve 54A is closed, while the open-close valve 82A disposed in the by-pass tubing 80A is opened.

Next, the open-close valves 78A, 78B and 78C are opened, whereby high pressure air from the high pressure air source 72 is supplied to the air ejector 30A connected to the ink supply tubing 20 and the air ejectors 30B and 30C connected to the ink recovery tubings 22 and 24, respectively. Air in the ink supply tubing 20 and the ink recovery tubings 22 and 24 flows at a high speed from the ink reservoir 16 to the air ejector 30A and to the air ejectors 30B and 30C, respectively, and thereafter flows toward the ink supply source 18. On the other hand, at almost the same time that the high pressure air is supplied to the air ejectors 30A, 30B and 30C, water flowing from the water supply tubing 28 is supplied to the ink supply tubing 20 and the ink recovery tubings 22 and 24, respectively, via open-close the valves 68A, 68B and 68C which are controlled at desired time intervals. By controlling the open-close valves 68A, 68B and 68C connected to the water supply tubing 28, the time intervals for water supplying can be adjusted in any desired way. The desired time intervals for supplying water can be selected depending upon various conditions, such as the amount of flexographic ink remaining in the ink supply tubing 20 and the ink recovery tubings 22 and 24, or the flow speed of the air generated by the air ejectors 30A, 30B and 30C. Therefore, the flexographic ink remaining in the ink supply tubing 20 and the ink recovery tubings 22 and 24 can be prevented from being solidified by supplying water therein, even when the moisture in the flexographic ink is evaporated by virtue of the high speed air flow. Thus, the flexographic ink remaining in the ink supply tubing 20 and the ink recovery tubings 22 and 24 can be effectively removed therefrom, and then returned back to the ink supply source 18, and the inner surfaces of the ink supply tubing 20 and the ink recovery tubings 22 and 24 can be rinsed out.

When it is intended not only to remove or rinse out the flexographic ink remaining in the ink supply tubing 20 and the ink recovery tubings 22 and 24, but also intended to reuse the recovered flexographic ink, the amount of water being supplied can be adjusted depending upon the measurements of the water flow meters 66A, 66B and 66C, so that the ratio of supplied water to the recovered flexographic ink will not exceed a certain level. Preferably, the amount of water being supplied may be determined in relation to the viscosity of the ink being recovered, which viscosity is detected by the viscometer 52, since too large an amount of supplied water causes the viscosity of the ink to be too low, which results in the deterioration of the printing quality. In another embodiment of the present invention, the water flow meters 66A, 66B and 66C may be disposed to be upstream of open-close valves 68A, 68B and 68C, respectively. Also, in another embodiment of the present invention, viscometers may be disposed in the path of the ink recovery tubings 22 and 24, as well.

The remaining flexographic ink left upon the surfaces of the inking roller 12 and the ink squeezing roller 14 is a small amount such as 50 grams in weight, so that it will be preferable to remove such ink by shaving it off with a scraper with the aid of a small amount of a diluting agent. In this case, the ink removed by the scraper should not be recovered via the ink supply tubing 20 or the ink recovery tubings 22 and 24 for scrapping, in order to prevent the ink from again adhering on the inner surfaces of the ink supply tubing 20 and the ink recovery tubings 22 and 24.

The operation for removing and/or recovering the flexographic ink remaining in the ink supply tubing and/or the ink recovery tubings, which can retain the recovered ink in the reusable form, has finished. Upon a color change, the ink supply source will be replaced with new one which contains ink of the desired color.

The inventor has carried out an experiment for confirming the advantages of the present invention, the results of which will explained below. The conditions for the experiment were as follows:

(1) Kind of ink used: flexographic ink
Viscosity of ink: 9.0 sec (measured by a Zahn cup No. 4)

(2) Kind of sheets used: corrugated board sheets (3) Air ejectors: high pressure air of 5 kg/cm$^2$ was supplied (4) Amount of water supplied: supply of total of 30 cc per tubing is divided into three times (5) Ink supply/recovery tubings: 8 mm in inner diameter, about 5 m in length, made of transparent plastic The procedure of the experiment will now be described. The flexographic ink being kept in the ink reservoir 16 is recovered therefrom and returned back to the ink supply source 18. Air in the ink supply tubing 20 and the ink recovery tubings 22 and 24 is made to flow at a high speed by using the air ejector, during which water is supplied into the ink supply tubing 20 and the ink recovery tubings 22 and 24 from the water supply tubing 28 three times. Thereafter, the appearance and the viscosity of the flexographic ink still remaining in the ink supply tubing and/or the ink recovery tubings was observed.

The results of the experiment will now be described. Air in the ink supply tubing 20 and the ink recovery tubings 22 and 24 flowed at the speed of about 5 m/sec, and by the force of this air flow, almost all of the flexographic ink remaining in the ink supply tubing 20 and the ink recovery tubings 22 and 24, and the water supplied therein from the water supply tubing 28, had been almost completely been recovered and returned back to the ink supply source 18. Neither the flexographic ink nor the water could be observed in the ink supply tubing 20 and the ink recovery tubings 22 and 24. More particularly, at the third recovery of the flexographic ink, even a small amount of water containing little ink from the ink supply tubing 20 and the ink recovery tubings 22 and 24 could be completely recovered and returned back to the ink supply source 18 by closing the open-close valves 68 to halt the supply of water, while at the same time causing the high speed air flow of the air ejectors.

More precisely, the total weight of the flexographic ink circulating between the ink supply source 18 and ink reservoir 16 was 7 kg, whereas the weight of the flexographic ink remaining in the ink supply tubing 20 and/or the ink recovery tubings 22 and 24 after the printing operation was finished was about 100 grams, which required about 60 seconds to be recovered. On the other hand, the printing machine of the prior art which only utilizes the effect of gravity for recovering the flexographic ink requires normally about 300 seconds for the recovery operation. Thus the present invention provides a recovery operation which takes only about one fifth the time that the one of the prior art takes. The viscosity of the flexographic ink recovered with the supplied water of 90 cc was 8.8 sec, which ink can be used for the printing operation without any adverse effects thereon.

According to the results of the experiment described above, it is advantageous to utilize the ink supply tubing 20 and the ink recovery tubings 22 and 24 the inner diameters of which are in a range from about 6 mm to 10 mm, in order to generate a high speed air flow exceeding more than 5 m/sec flowing in a tubing having a length of about 5 m by using a commonly available high pressure air source of 5 $kg/cm^2$, while at the same time to circulate the flexographic ink having the viscosity of 12 sec (measured by a Zahn cup No. 4) in a good condition.

Figure 4:
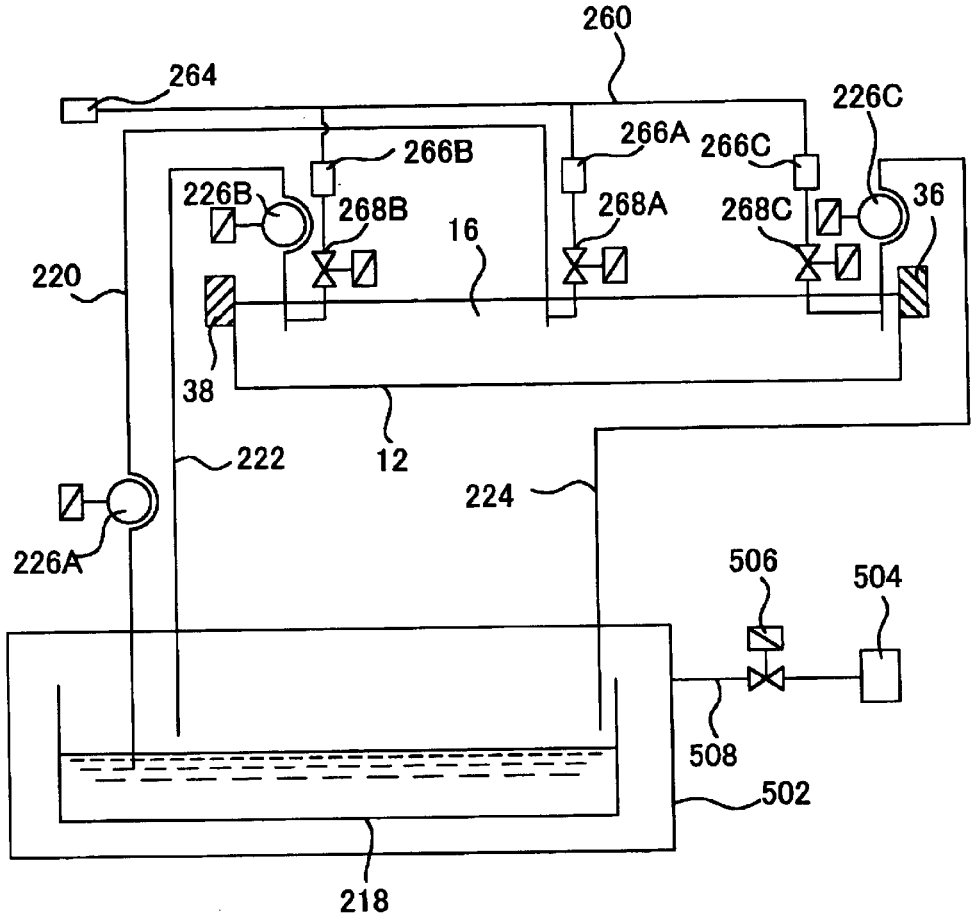
FIG. 4 is a piping diagram showing the second embodiment of the present invention.

Reference will now be made to FIG. 4 which illustrates a second embodiment of the present invention, where components the same as those described in relation to the first embodiment are given the same reference numerals as are given to said components in the first embodiment.

FIG. 4 is a piping diagram showing the second embodiment of the present invention. As can be seen in FIG. 4, this embodiment is characterized by its transfer means for recovering the ink after the printing operation has finished. More particularly, an ink supply source 218 is enclosed in a sealing chamber 502, which chamber is in fluid communication with a vacuum source 504 via connection tubing 508 and an open-close valve 506. According to this embodiment, the flexographic ink is recovered from the ink reservoir 16 and returned back to the ink supply source 218 in the same way as in the first embodiment described above. Thereafter, air in the sealing chamber 502 is exhausted by opening an open-close valve 506 disposed along the connection tubing 508 and by turning the vacuum source 504 on, whereby the mixture of the flexographic ink and the rinsing water remaining in an ink supply tubing 220 and ink recovery tubings 222 and 224 is recovered and therefrom and returned back to the ink supply source 218.

Figure 5:
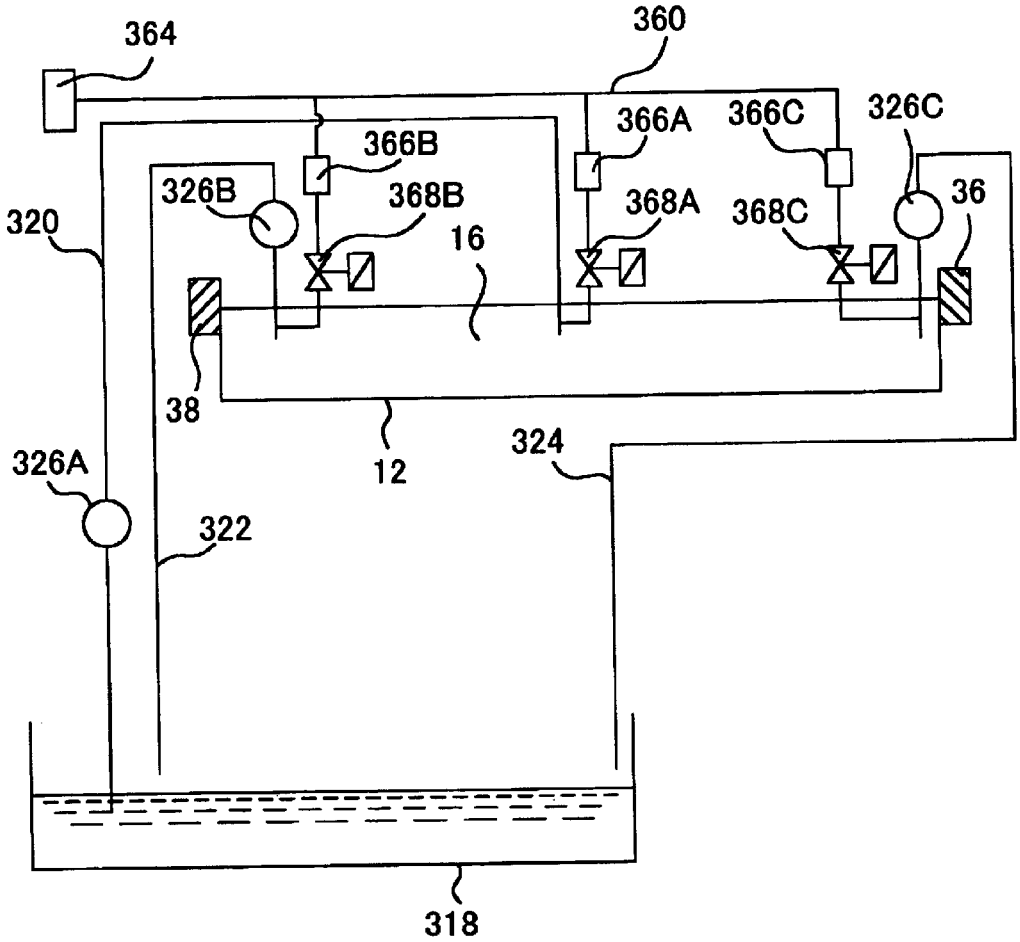
FIG. 5 is a piping diagram showing the third embodiment of the present invention.

FIG. 5 is a piping diagram showing the third embodiment of the present invention. As can be seen in FIG. 5, this embodiment is characterized by its transfer means for transferring ink between the ink reservoir 16 and an ink supply source 318. More particularly, whereas in the first embodiment the transfer means is tubing pumps, it is Mono pumps 326A, 326B and 326C in this embodiment.

The Mono pump is a positive displacement pump of a rotational type including a threaded eccentric shaft, which comprises a stator (not shown) and a rotor (not shown) disposed within the stator, such that the rotor is always kept in line contact with the stator, whereby a sealed helical channel is formed between them. When the rotor is moved in both rotational and reciprocate directions within the stator, the fluid in the helical channel is transferred thereby, which enables a pressure difference to be created between its upstream and downstream for generating air flow therethrough.

The ink is supplied from an ink supply source 318 to the ink reservoir 16 via an ink supply tubing 320 by the Mono pump 326A before printing. Also, during the printing operation, the ink is supplied to the ink reservoir 16 via the ink supply tubing 320 by the Mono pump 326A, while at the same time, the ink is recovered from the ink reservoir 16 and returned back to the ink supply source 318 via ink recovery tubings 322 and 324 by Mono pumps 326B and 326C, which circulate the flexographic ink and provide a continuous movement thereof similar to in the first embodiment. When the printing operation has finished, the flexographic ink remaining in the ink reservoir 16 is recovered and returned back to the ink supply source 318. Thereafter, the Mono pumps 326A, 326B and 326C are driven at a high speed, which generates a high speed air flow passing through the ink supply tubing 320 and ink recovery tubings 322 and 324, in order to recover the mixture of the flexographic ink and water remaining in the ink supply tubing 320 and the ink recovery tubings 322 and 324 and return it back to the ink supply source 318. Thus, the flexographic ink and water remaining in the ink supply tubing 320 and the ink recovery tubings 322 and 324 is recovered and returned back to the ink supply source 318.

The Mono pumps can be operated not only to transfer the flexographic ink before and during the printing operation, but also to remove and/or recover the flexographic ink and water after the printing operation has finished. This embodiment does not include the air ejectors or open-close valves in the first embodiment. This embodiment, however, can accomplish the transfer operation of the flexographic ink as well as the recovery operation of the flexographic ink and water just by the transferring pump for the flexographic ink, since the pump can generate a high speed air flow in the ink supply tubing 20 and the ink recovery tubings 322 and 324. In another embodiment of the present invention, gear pumps may be utilized instead of the Mono pumps, which gear pumps can also generate an air flow during the operation thereof.

Figure 6:
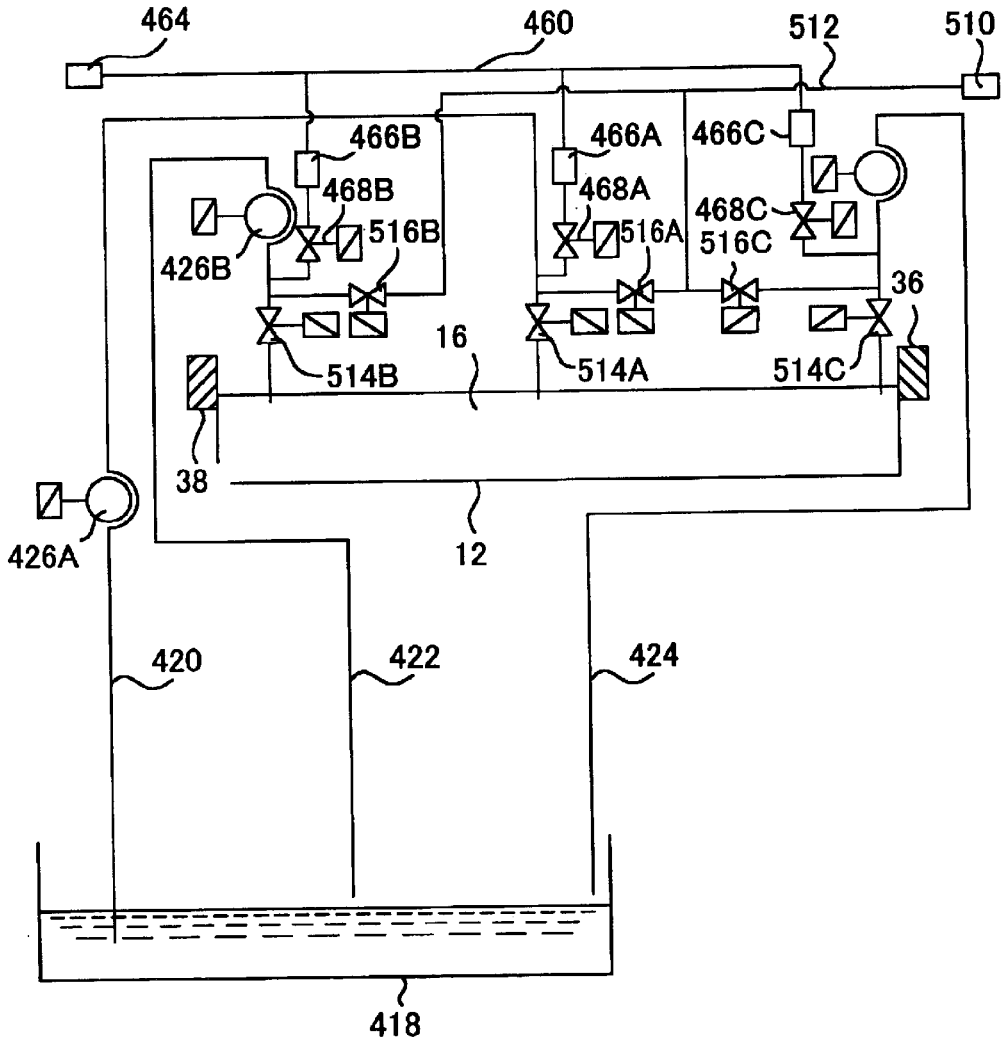
FIG. 6 is a piping diagram showing the forth embodiment of the present invention.

FIG. 6 is a piping diagram showing the fourth embodiment of the present invention. As can be seen in FIG. 6, this embodiment is characterized by its air flow generating means for removing and/or recovering the flexographic ink remaining in an ink supply tubing 420 and ink recovery tubings 422 and 424. This embodiment does not include the air ejectors in the first embodiment. More particularly, a high pressure air source 510 is connected via a connection tubing 512 to the ink supply tubing 420 and the ink recovery tubings 422 and 424 at their portions adjacent to the ink reservoir 16. The remaining ink and rinsing water are recovered and returned back to a ink supply source 418 by the force of high pressure air supplied to the ink supply tubing 420 and the ink recovery tubings 422 and 424. In order to accomplish such operations, an open-close valve 514A is disposed in the ink supply tubing 420 in close proximity to an opening end thereof adjacent to the ink reservoir 16, and the connection tubing 512 in fluid communication with the high pressure air source 510 is connected via an open-close valve 516A to one end of the open-close valve 514A opposite to the ink reservoir 16. Also, open-close valves 514B and 514C are disposed in the ink recovery tubings 422 and 424 in close proximity to opening ends thereof adjacent to the ink reservoir 16, and the connection tubing 512 in fluid communication with the high pressure air source 510 is connected via open-close valves 516B and 516C to the ends of the respective open-close valves 514B and 516C opposite to the ink reservoir 16.

When the printing operation has finished, the flexographic ink remaining in the ink reservoir 16 is recovered therefrom and returned back to the ink supply source 418. Thereafter, the open-close valves 514A, 514B and 514C are closed, the open-close valves 516A, 516B and 516C are closed, and open-close valves 468A, 468B and 468C are opened. High pressure air is supplied from the high pressure air source 510 to the ink supply tubing 420 and the ink recovery tubings 422 and 424, while water is supplied from a water supply source 464 to the ink supply tubing 420 and the ink recovery tubings 422 and 424. Thus, the flexographic ink and water remaining in the ink supply tubing 420 and the ink recovery tubings 422 and 424 is recovered therefrom and returned back to the ink supply source 418.

Although the best modes contemplated by the inventor for carrying out the present invention have been shown and described herein, it will be apparent to those skilled in the art that suitable modifications, variations, and equivalents may be made without departing from the scope of the invention.

For example, in relation to the first embodiment which recovers the flexographic ink from the ink reservoir 16 and returns it back to the ink supply source 18 via the ink supply tubing 20 and the ink recovery tubings 22 and 24, the opening ends thereof are positioned to be stationary in the flexographic ink being kept in the ink reservoir 16. It may be advantageous, however, to move the ink supply tubing 20 in the longitudinal direction of the ink reservoir 16 by the rotation of the threaded shaft 56 to promote recovering of the flexographic ink in the ink reservoir 16. The ink recovery tubings 22 and 24 may also be moved in the longitudinal direction of the ink reservoir 16 for recovering the flexographic ink, if desired.

Also, in the first embodiment, the means for transferring the flexographic ink between the ink supply source 18 and the ink reservoir is the tubing pump which has the support member moveable toward and apart from the rotor. However, a tubing pump which does not have any support member moveable toward and apart from the rotor or a diaphragm pump may be used instead. In a case where either of such pumps is utilized, the flexographic ink and water can be quickly recovered and returned back to the ink supply source 18, as the tubing pump in the first embodiment, by providing a by-pass tubing across the pump, and then opening the by-pass tubing in a suitable manner to reduce the resistance to the high speed air flow in the ink supply tubing 20 and the ink recovery tubings 22 and 24 only when the flexographic ink and water remaining in these tubings are to be recovered and returned back to the ink supply source 18.

Furthermore, in the first embodiment, all of the remaining flexographic ink and water is recovered from the ink supply tubing 20 and the ink recovery tubings 22 and 24 by a high speed air flow. It may be possible, however, especially when the viscosity of the flexographic ink is high and required for further rinsing of the ink supply tubing 20 and the ink recovery tubings 22 and 24, to supply additional water after the above described water has been supplied, which is not returned back to the ink supply source 18 but instead to any other container. Such additional water will not cause to harm to the environment, since its amount is small.

Also, in the first embodiment, the high speed air flow and the small amount of water is supplied simultaneously to the ink supply tubing 20 and the ink recovery tubings 22 and 24, upon recovery of the remaining flexographic ink from the ink supply tubing 20 and the ink recovery tubings 22 and 24. It may be possible, however, to remove the remaining water more completely by continuing to supply a high speed air flow for a longer time in the final recovery operation. Such an operation prevents the ink from being diluted by remaining water in successive printing operations.

In addition, in the second and the fourth embodiments, it may be advantageous to release the ink supply tubing 420 and the ink recovery tubings 422 and 424 from the tubing pumps 426A, 426B and 426C upon recovery of the flexographic ink, in order to completely recover the remaining flexographic ink and water from the ink supply tubing 420 and the ink recovery tubings 422 and 424 and return it back to the ink supply source 418.

Therefore, according to the apparatus for removing and/or recovering ink, a printing machine including such an apparatus, and a method for supplying and/or recovering ink of the present invention, the ink remaining in the ink delivery tubings connecting the ink reservoir to the ink supply source is completely removed therefrom by supplying an air flow therethrough, thereby preventing a change of printing color due to the mixture of a previous ink and a new ink.

Also, according to the apparatus for removing and/or recovering ink, a printing machine including such an apparatus, and a method for supplying and/or recovering ink of the present invention, the ink remaining in ink delivery tubings connecting the ink reservoir to the ink supply source can quickly be removed or rinsed out by supplying a high speed air flow and water in the ink delivery tubings.

Furthermore, according to the apparatus for removing and/or recovering ink, a printing machine including such an apparatus, and a method for supplying and/or recovering ink of the present invention, the ink remaining in the ink delivery tubings can be recovered in its reusable form therefrom by supplying a high speed air flow and a small amount of water in said tubings.

What is claimed is:

1. A printing machine comprising:

an ink reservoir;

an ink supply source; and at least one ink delivery path connecting said ink reservoir to said ink supply source so that ink from said ink supply source can be supplied via said ink delivery path to said ink reservoir and accumulated therein for printing, at least one ink mechanism that removes ink remaining in said ink delivery path, said ink removal mechanism including an air supply which supplies air into said ink delivery path with at least one of a flow rate and a flow volume sufficiently large enough so that the air flows toward said ink supply source in a direction away from said ink reservoir and so removes ink remaining on an inner surface of said ink delivery path, said ink delivery path including at least one ink supply tubing for supplying ink from said ink supply source to said ink reservoir, and at least one ink recovery tubing for recovering ink from said ink reservoir and returning the ink to said ink supply source, each of said at least one ink supply tubing and said at least one ink recovery tubing comprising an ink transfer mechanism which transfers ink between the ink reservoir and said ink supply source in one direction and another direction opposite to the one direction, and siad air supply, whereby at least one of (a) said ink supply tubing serves as an ink recovery tubing and (b) said ink recovery tubing serves as an ink supply tubing.

2. The printing machine according to claim 1, wherein said ink removal mechanism further includes at least one diluting liquid supply that supplies liquid in said ink delivery tubing such that the liquid flows toward said ink supply source from said ink reservoir in order to dilute said ink remaining therein.

3. The printing machine according to claim 2, wherein said ink removal mechanism further includes at least one of a viscometer for detecting the viscosity of said ink being removed from said ink delivery tubing, and at least one adjusting mechanism that adjusts the amount of diluting liquid supplied by said diluting liquid supply in response to the viscosity detected by said viscometer.

4. The printing machine according to claim 2, wherein said diluting liquid supply comprises diluting liquid tubings connected to be in fluid communication with said ink delivery path in close proximity to the opening ends thereof adjacent to said ink reservoir, and a diluting liquid source connected to said diluting liquid tubings, respectively.

5. The printing machine according to any one of claims 1 to 3, wherein said air supply comprises an air/gas introducer which introduces air/gas into said ink delivery path in close proximity to the opening ends thereof adjacent to said ink supply source.

6. The printing machine according to claim 1, wherein said ink reservoir is formed by an inking roller which applies said ink to a printing die, an ink squeezing member extending along the axis of said inking roller in contact with the same for the adjustment of the amount of said ink being applied to the printing die, and a pair of diaphragms or dam plates disposed at common end extremities of said inking roller and said ink squeezing member, comprising one or more driving means which move opening ends of at least one of said ink delivery tubings adjacent to said ink reservoir along said axis of the inking roller.

7. A printing machine as in claim 1, wherein said ink recovery tubing can both supply and recover ink.

8. The printing machine comprising:

an ink reservoir an ink supply source; and at least one ink delivery path connecting said ink reservoir to said ink supply source so that ink from said ink supply source can be supplied via said ink delivery path to said ink reservoir and accumulated therein for printing;

an air supply which supplies air into said ink delivery path with at least one of a flow rate and a flow volume sufficiently large enough so that the air flows toward said ink supply source in a direction away from said ink reservoir and so removes ink remaining on an inner surface of said ink delivery path, said air supply serving to transfer ink between said ink reservoir and said ink supply source via said ink delivery path at least one of (a) before and (b) during the printing operation, while said air supply removes ink remaining on the inner surface of said delivery path for reuse after ink is recovered from said ink reservoir to said ink supply source.

9. The printing machine according to claim 8, wherein each of said air supply comprises air flow tubings connected to be in fluid communication with said respective ink delivery tubings in close proximity to opening ends thereof adjacent to said ink supply source, and air suction means disposed within said air flow tubings for sucking air down from said ink delivery tubings by virtue of air flow passing through said air flow tubings.

10. A method for supplying/recovering ink wherein said ink is supplied and/or recovered via at least one of ink delivery tubings connected between an ink reservoir and an ink supply source, wherein the method includes the step of:

supplying a fast enough flow rate and/or strong enough flow volume of air into said ink delivery tubings so that the air flows toward said ink supply source in the direction away from said ink reservoir, and the step of supplying a diluting liquid in said ink delivery tubings intermittently such that the liquid flows toward said ink supply source from said ink reservoir, wherein both of said supplying steps occur simultaneously in order to recover said ink remaining on the inner surface of said ink delivery tubings;

detecting the viscosity of said ink being removed from said ink delivery tubings; and adjusting the amount of said diluting liquid in response to the viscosity detected by said step of detecting.

11. A preparation method for changing printing color, wherein the printing machine used for the method comprises an ink reservoir being formed by an inking roller which applies said ink to a printing die and an ink squeezing member extending along the axis of said inking roller in contact with the same for adjustment of the amount of said ink being applied to the printing die, an ink supply source for supplying ink to said ink reservoir, and one or more ink delivery tubings each connecting said ink reservoir to said ink supply source, whereby the ink supplied from said ink supply source via at least one of said ink delivery tubings to said ink reservoir and accumulated therein is used for printing, and thereafter the printing color is changed by replacing said ink supply source for a successive printing step using a different color, the method comprising the step of supplying said ink from said ink supply source to said ink reservoir via at least two of said ink delivery tubings, using at least one of said ink delivery tubings for supplying said ink from said ink supply source to said ink reservoir, while using at least one of the other of said ink delivery tubings for recovering said ink from said ink reservoir and returning it back to said ink supply source, whereby said ink is circulated between said ink supply source and said ink reservoir, and said ink accumulated in said ink reservoir is used for printing, using all of said ink delivery tubings in order to recover said ink from said ink reservoir and return it back to said ink supply source, while at the same time rotating said inking roller, so that remaining ink in said ink reservoir is recovered and returned back to said ink supply source, supplying a diluting liquid onto the surface of said inking roll, thereby removing or rinsing out said ink from the surface thereof, recovering said ink from said ink delivery tubings and returning it back to said ink supply source, by supplying a fast enough flow rate and/or strong enough flow volume of air into said at least two of ink delivery tubings such that the air flows toward said ink supply source in the direction away from said ink reservoir, replacing said ink supply source in which remaining ink has been recovered therein with an ink supply source of another color.

* * * * *